US011357294B2

(12) United States Patent
Hashimoto

(10) Patent No.: US 11,357,294 B2
(45) Date of Patent: Jun. 14, 2022

(54) FASTENER FOR ACCESSORIES

(71) Applicant: HOUSEKI-NO-ANGEL CO., LTD., Nagoya (JP)

(72) Inventor: Hisaziro Hashimoto, Nagoya (JP)

(73) Assignee: HOUSEKI-NO-ANGEL CO., LTD., Nagoya (JP)

( * ) Notice: Subject to any disclaimer, the term of this patent is extended or adjusted under 35 U.S.C. 154(b) by 0 days.

(21) Appl. No.: 17/605,221

(22) PCT Filed: Dec. 11, 2019

(86) PCT No.: PCT/JP2019/048393
§ 371 (c)(1),
(2) Date: Oct. 20, 2021

(87) PCT Pub. No.: WO2021/117152
PCT Pub. Date: Jun. 17, 2021

(65) Prior Publication Data

US 2022/0142309 A1 May 12, 2022

(51) Int. Cl.

| | |
|---|---|
| ***A44C 5/20*** | (2006.01) |
| ***F16B 2/10*** | (2006.01) |
| ***A44C 5/18*** | (2006.01) |

(52) U.S. Cl.
CPC ..... *A44C 5/185* (2013.01); *A44D 2203/00* (2013.01)

(58) Field of Classification Search
CPC ..... A44C 5/2057; A44C 5/2066; A44C 25/00; A44C 5/2019; A44C 5/20; A44C 5/2033;
(Continued)

(56) References Cited

U.S. PATENT DOCUMENTS 2,475,226 A * 7/1949 Ellis ..... A41F 1/002 211/DIG. 1
3,376,616 A * 4/1968 Kaczorowski ..... A44B 11/258 24/303

(Continued)

FOREIGN PATENT DOCUMENTS

| | | | |
|---|---|---|---|
| CN | 101884457 | A | 11/2010 |
| JP | 2012-192157 | A | 10/2012 |
| JP | 2013-81524 | A | 5/2013 |

OTHER PUBLICATIONS

Hashimoto, H., International Application No. PCT/JP2019/048393, International Search Report, dated Feb. 4, 2020, 5 pages with English translation.

(Continued)

*Primary Examiner* — Jack W Lavinder
(74) *Attorney, Agent, or Firm* — Rahman LLC

(57) ABSTRACT

A fastener for accessories includes a male part and a female part. The female part is a crocodile clip, which includes a pair of jaw members operable to open/close by a spring force. The fastener for accessories includes a first attraction part and a second attraction part. The first attraction part is located at an inner space in the pair of the jaw members. The second attraction part is located at the front part of the locking part. The first attraction part is located at either one of the jaw members. In addition, a holder, into which the second attraction part of the locking part is inserted, is placed in front of the first attraction part located in the crocodile clip.

5 Claims, 9 Drawing Sheets

(58) Field of Classification Search
CPC ..... A44C 5/185; F16B 2/10; A44B 11/2592; A44B 17/0076; A44B 13/02; Y10T 24/32; A44D 2203/00
See application file for complete search history.

(56) References Cited

U.S. PATENT DOCUMENTS

| | | | | |
|---|---|---|---|---|
| 6,508,080 | B1 | 1/2003 | Ninomiya | |
| 7,073,232 | B1 * | 7/2006 | Fuhrman | A44C 5/2042 24/303 |
| 8,904,821 | B1 * | 12/2014 | DiPietro | A44C 5/2057 63/3.1 |
| 2015/0047156 | A1 * | 2/2015 | Ninomiya | A44C 5/2076 24/595.1 |

OTHER PUBLICATIONS

Hashimoto, H., International Application No. PCT/JP2019/048393, Written Opinion, dated Feb. 4, 2020, 5 pages with English translation.
Hashimoto, H., China Application No. 201980095662.2, CNIPA Office Action, dated Mar. 15, 2022, 11 pages with English translation.

* cited by examiner

FASTENER FOR ACCESSORIES

CROSS-REFERENCE TO RELATED APPLICATIONS

This application is a 371 national stage application of PCT/JP2019/048393 filed on Dec. 11, 2019, the complete disclosure of which, in its entirety, is herein incorporated by reference.

FIELD OF THE INVENTION

The present invention relates to a fastener for accessories such as necklace, bracelet, anklet, key holder, bag, belt and the like.

BACKGROUND ART

Conventionally, various kinds of fasteners are used to fasten accessories such as a neckless. For example, a stopper having a magnet is disclosed (refer to Patent Document 1). The magnet is provided inside one of a pair of jaw members of a crocodile clip serving as a concave portion, and a magnet is provided at a distal end portion of the engaging member of the convex portion. And, a tip portion of the convex portion is guided into the crocodile clip of the concave portion by being affected by a magnetic force by locating the distal end portion of a locking member of the convex portion near a tip of the crocodile clip of an open concave portion, and the concave portion and the convex portion are locked.

Further, a clasp, which can be applied to an accessory, facilitates the mounting of an accessory, is disclosed (refer to Patent document 2). The clasp is easily connectable by one hand, and is further miniaturized.

Furthermore, a clasp of an accessory of an accessory is disclosed in which a magnet is provided at a tip of a projecting piece, and a magnet for attracting a magnet of a projecting piece is provided at a back of an inserting hole (see, for example, Patent Document 3). In this reference 3, a step is provided with a step at the root of the projecting piece, and a fall-off preventing mechanism is provided on the main body so as to be caught by a step of a root of the projecting piece inserted into the inserting hole and prevent the projecting piece from coming off the inserting hole, and further, the plug is provided with a plug.

CITATION LIST

Patent Literature

Patent Reference 1: Japanese Patent No. 4044598

Patent Reference 2: Japanese Laid-Open Patent Application No. 2012-192157 Publication Patent Reference 2: Japanese Laid-Open Patent Application No. 2013-81524 Publication

BRIEF SUMMARY OF THE INVENTION

Problems that Invention is to Solve

However, the above-mentioned fasteners, such as the patent references 1 to 3, still have their disadvantages mentioned below.

Firstly, fasteners for personal accessories shown in Patent references 1 to 3 have a risk to be disengaged by accident. This will be explained referring to FIG. 5 and FIG. 6. In FIG. 6, even when a crocodile clip (20) as a female and a locking part (21) as a male part are pulled to opposite directions along a central line of a longitude axis from each other, they cannot be disengaged, because a neck part (22) of the locking part (21) is stopped by a stopping part (23) of the crocodile clip (20). On the other hand, as shown in FIG. 5, when the locking part (21) is pulled to an oblique direction (such as six o'clock direction), which is not the direction along the central line of the longitude axis, the locking part (21) can widen an insertion opening of a jaw member, which comprises the crocodile clip (20) as a female part. As a result of this, there is a risk that the locking part (21) can be disengaged from the insertion opening of the crocodile clip (20) by accident.

Therefore, to prevent the locking part from being disengaged when pulling the locking part to the oblique direction, which is not along the direction of the central longitude axis of the crocodile clip, the patent reference 1 keeps a spring force of the crocodile clip strong to maintain the clothing states. As a result of this, the fastener can result in a larger scale, or the fastener is hard to handle, since they cannot be disengaged without pinching the back of the crocodile clip to an inner direction with a strong finger force.

Secondly, there is a problem wherein a male part and a female part, which comprise a fastener, cannot be easily engaged or disengaged. Generally, a fastener for an accessory such as a necklace is too small to easily engage or disengage by only relying on a visual inspection. Sometimes, the operation is taken place at the back of his/her neck. In this case, for example, as shown in FIG. 7, a fastener, which is shown in the Patent reference 2, has a plurality of edge parts (30*a*) near an opening of a crocodile clip (30). In this case, even if the crocodile clip (30) as a female part opens to the length of a diameter of an attraction part (31*a*) of a locking part (31) when the opening length is not wide enough, the locking part (31) touches with either one of the edge parts (30*a*). Consequently, the crocodile clip (30) and the locking part (31) are not smoothly engaged.

Furthermore, the same problem will occur when they are disengaged (refer to FIG. 9). When the crocodile clip (30) does not open enough, in other words, when the crocodile clip (30) opens to the length of the diameter of the attraction part (31*a*) of the locking part (31), the attraction part (31*a*) of the locking part (31) cannot be disengaged by being in contact to the edge (30*a*) of the crocodile clip (30) or a stopping part, because an attraction part (30*b*) of the crocodile clip (30) is situated at the back of an underside stopping part. Herein, when it opens completely, since the attraction part (30*b*) of the crocodile clip (30) is situated along the central line of a longitude of the crocodile clip (30), the attraction part (31*a*) of the locking part (31) can smoothly be disengaged without being in contact to the stopping part. In case when the engagement or disengagement is taken place at the back of his/her neck, it is impossible to judge whether it opens completely or incompletely. As a result of this, the crocodile clip (30) and the locking part (31) cannot be smoothly engaged or disengaged.

Furthermore, an engagement/disengagement shown in Patent reference 1 and Patent reference 3 has the same problem. It will be explained by referring to FIG. 5, FIG. 6, or FIG. 8. Even if a crocodile clip (20) as a female part opens to a length of a diameter of a magnetic part of a locking part (21) when the locking part (21) is pulled to the 10 o'clock direction, a neck part (22) of the locking part is forced to be in contact with a stopping part (23). Consequently, the crocodile clip (20) and the locking part (21) cannot be smoothly engaged or disengaged.

The present invention has been made in view of the above-mentioned problems, and has an objective to provide a fastener for accessories that a locking part cannot be disengaged from a crocodile clip as a female part by accident, even if the locking part as a male part is pulled to any directions. The other objectives of the fastener for accessories are easy to handle and make the locking part certainly inserted in the crocodile clip when engaged. The another objective is that, when engaged/disengaged, as long as the crocodile clip opens to a diameter length of an attraction part of a locking part, the fastener for accessories can be smoothly engaged or disengaged without being in contact with a stopping part, even when the locking part is pulled to any directions.

Means to Solve the Problems

In order to solve the abovementioned issues, the present invention is a fastener for accessories, which engages a female part located at one end of a chain accessory with a male part located at another end side of the chain accessory to lock them: wherein the female part and the male part comprise an attraction part and an attraction part respectively; wherein the attraction part and the attraction part have a part of a pair of magnets respectively or have a magnetic part and a metal part attracted to each other respectively; wherein the attraction part and the attraction part are located in a position to guide the female part and the male part to a correct position; wherein the female part is a crocodile clip comprising a pair of jaw members, which are able to open/close by a spring force; wherein the male part is a locking part, which is inserted and locked in a space between the pair of jaw members when they are in an open state; wherein the attraction part is located in an inner space of the pair of the jaw members; wherein the crocodile clip comprises the pair of the jaw members; wherein the attraction part is located at the front part of the locking part; wherein the attraction part, which is located in the crocodile clip, is set to either one of the pair of the jaw members; and wherein the fastener for accessories comprises a holder, into which the attraction part of the locking part is inserted, that is placed in front of the attraction part.

In this fastener for accessories, preferably, wherein an opening of the holder is directed towards a lateral direction, provided that an opening of the crocodile clip is directed towards a lateral direction; and wherein the holder forms a guide surface, which guides a horizontal slide of the locking part in an inner space of the holder.

In this fastener for accessories, preferably, wherein the holder is a cylindrical holder, into which the cylindrical-locking part can be inserted.

In this fastener for accessories, preferably, wherein the guide surface is a continuous surface comprising an inner surface of the cylindrical holder and a notch surface, which is a semicircular insertion and is formed at the jaw member out of the pair of jaw members.

In this fastener for accessories, preferably, wherein a bottom half of the opening side of the cylindrical holder is interconnected with the semicircular insertion, which is formed at the jaw member out of the pair of the jaw members; wherein a top half of the opening side of the cylindrical holder is engaged/disengaged with the jaw member out of the pair of the jaw members; and wherein a stopping part is placed at a tip of the said jaw member.

Effects of the Invention

A fastener for accessories according to the invention comprises a crocodile clip as a female part and a locking part as a male part. The crocodile clip comprises a pair of jaw members operable to open/close by a spring force. The locking part is inserted in a space between the pair of jaw members in an open state and is locked between the jaw members. An attraction part is located at an inner space in the pair of the jaw members. The crocodile clip comprises the pair of the jaw members. Another attraction part is located at the front part of the locking part. The attraction part is located in the crocodile clip and is set to either one of the pair of the jaw members. The fastener for accessories comprises a holder, into which the attraction part of the locking part is inserted, that is placed in front of the attraction part. With this configuration, the fastener for accessories according to the invention cannot be disengaged from the crocodile clip as a female part by accident, even if the locking part as a male is pulled to any directions. The fastener for accessories is also easy to handle and makes the locking part certainly inserted in the crocodile clip when they are engaged.

BEST MODE FOR CARRYING OUT THE INVENTION

Embodiment

Figure 1:
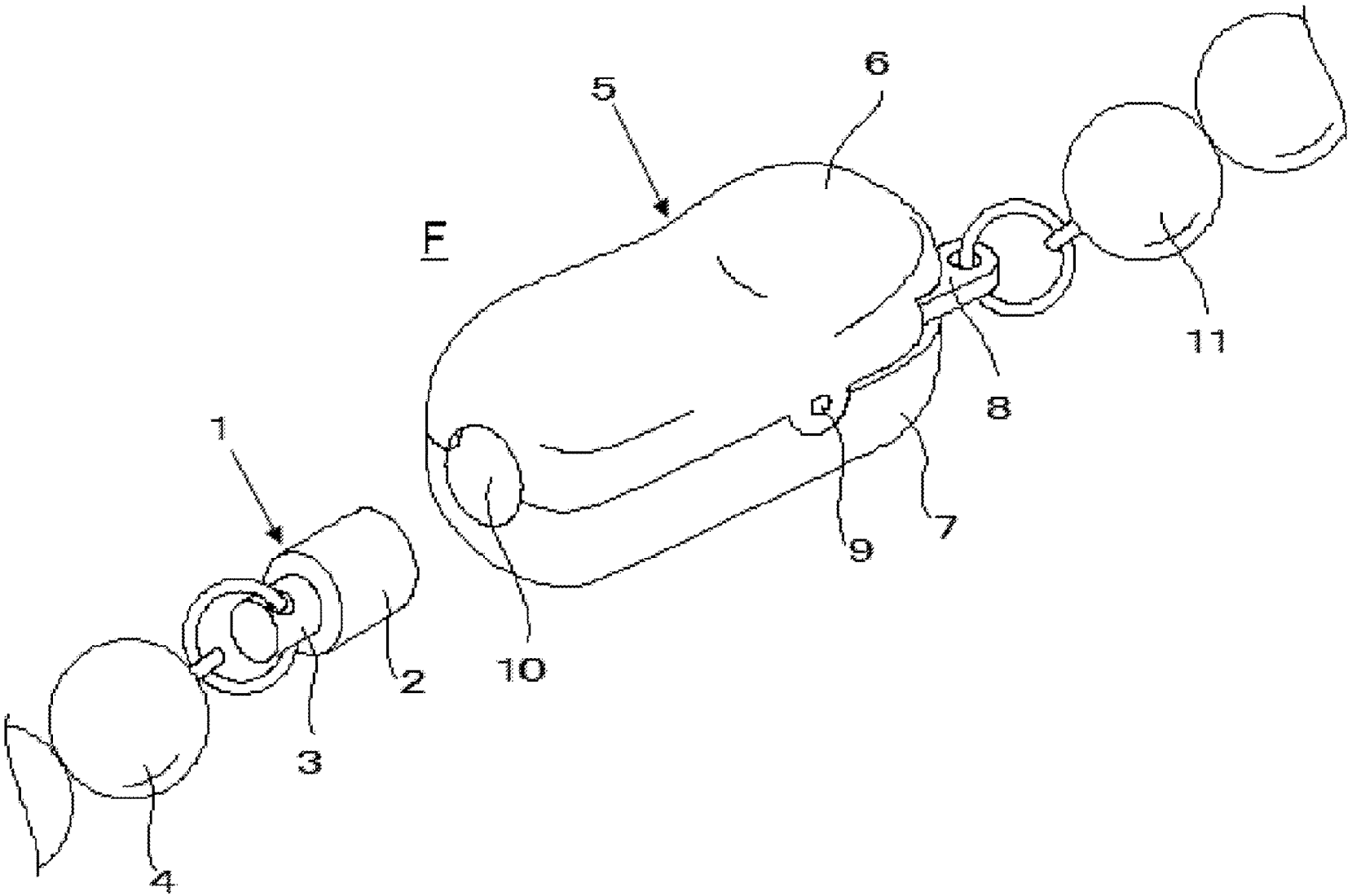
FIG. 1 shows a perspective view of a fastener for accessories according to an embodiment of the present invention.
Figure 2:
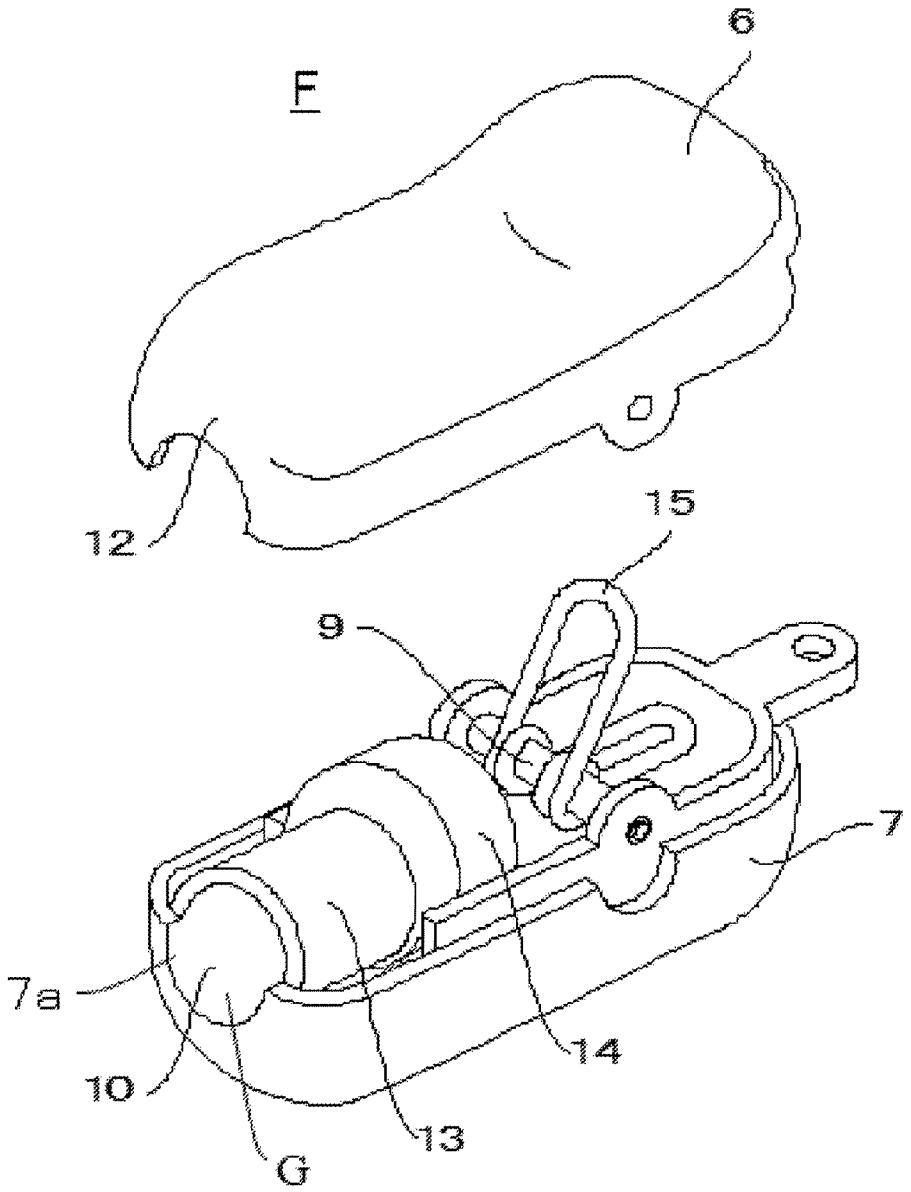
FIG. 2 shows an exploded perspective view of a crocodile clip comprising the fastener for accessories.

Hereinafter referring to the drawings, the embodiment of a fastener for accessories according to the present invention will be explained. As shown in FIG. 1 and FIG. 2, a fastener for accessories (F) according to this embodiment comprises a male part (1) and a female part (5). The female part (5) is a crocodile clip (5), which comprises a pair of jaw members (6 and 7) operable to open/close by a spring force. The male part (1) is a locking part (1), which is inserted in a space between the pair of jaw members (6 and 7) in an open state, and which is locked between the jaw members (6 and 7).

An attraction part (14) is located at an inner space in the pair of the jaw members (6 and 7). The crocodile clip (5) comprises the pair of the jaw members (6,7). Another attraction part (2) is located at the front part of the locking part (1). The attraction part (14) is located at either one of the jaw members (in this embodiment, the jaw member 7). In addition, a holder (13), into which the attraction part (2) of the locking part (1) is inserted, is placed in front of the attraction part (14) located in the crocodile clip (5). Herein, in this embodiment, a part that can guide to a correct locking position means that a pair of attraction parts is located to the position where the female part (5) and the male part (1) are to be engaged smoothly. The attraction part (2) and (14) are such as a pair of magnetic parts comprising N and S poles.

Figure 3:
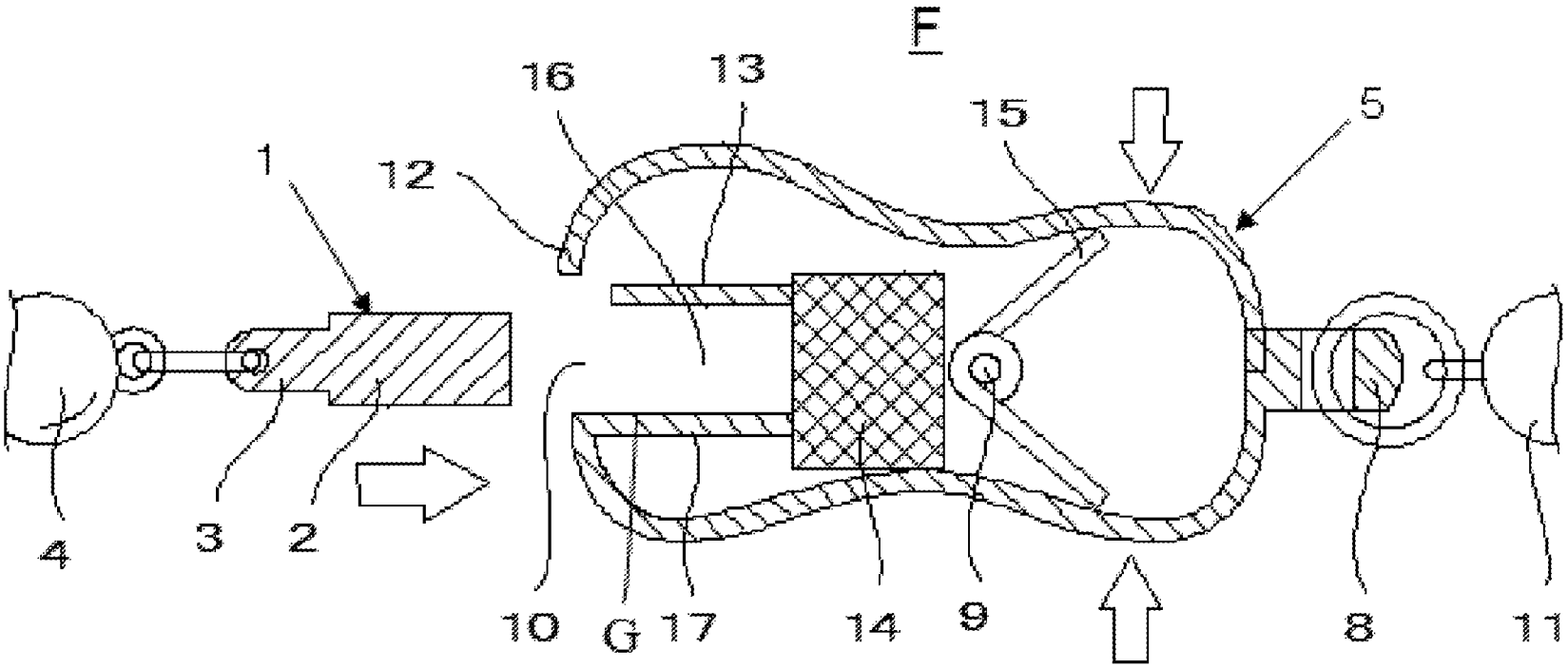
FIG. 3 shows a view for explaining a state of disengagement of the crocodile clip and a locking part comprising the fastener for accessories.
Figure 4:
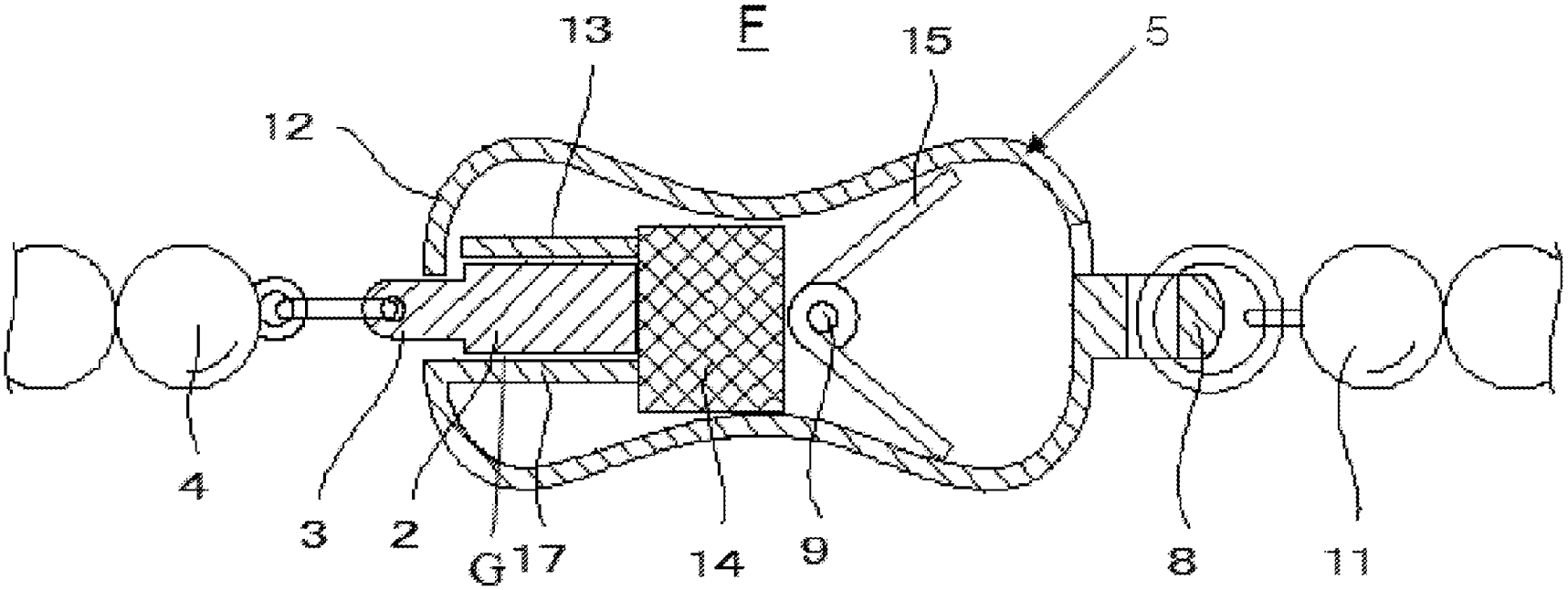
FIG. 4 shows a view for explaining an engagement state of the crocodile clip and the locking member.
Figure 5:
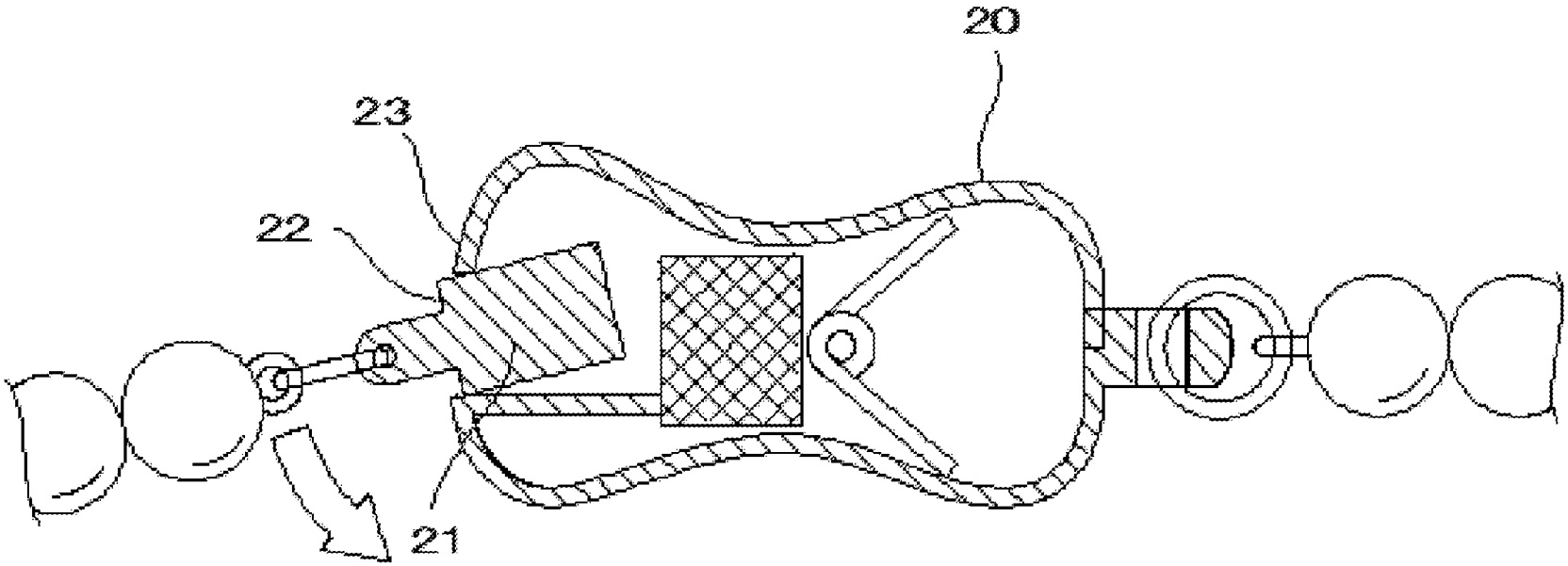
FIG. 5 shows a cross-sectional view of a fastener according to Reference 1.
Figure 6:
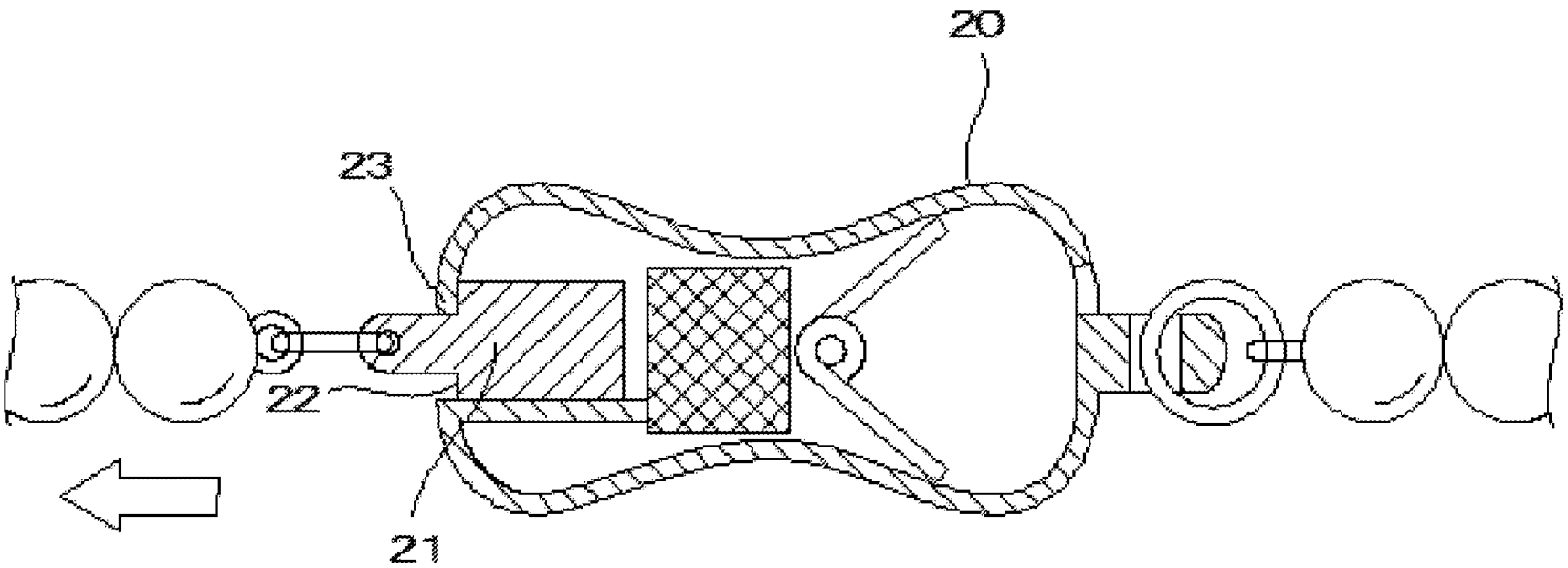
FIG. 6 shows a cross-sectional view of said fastener.
Figure 7:
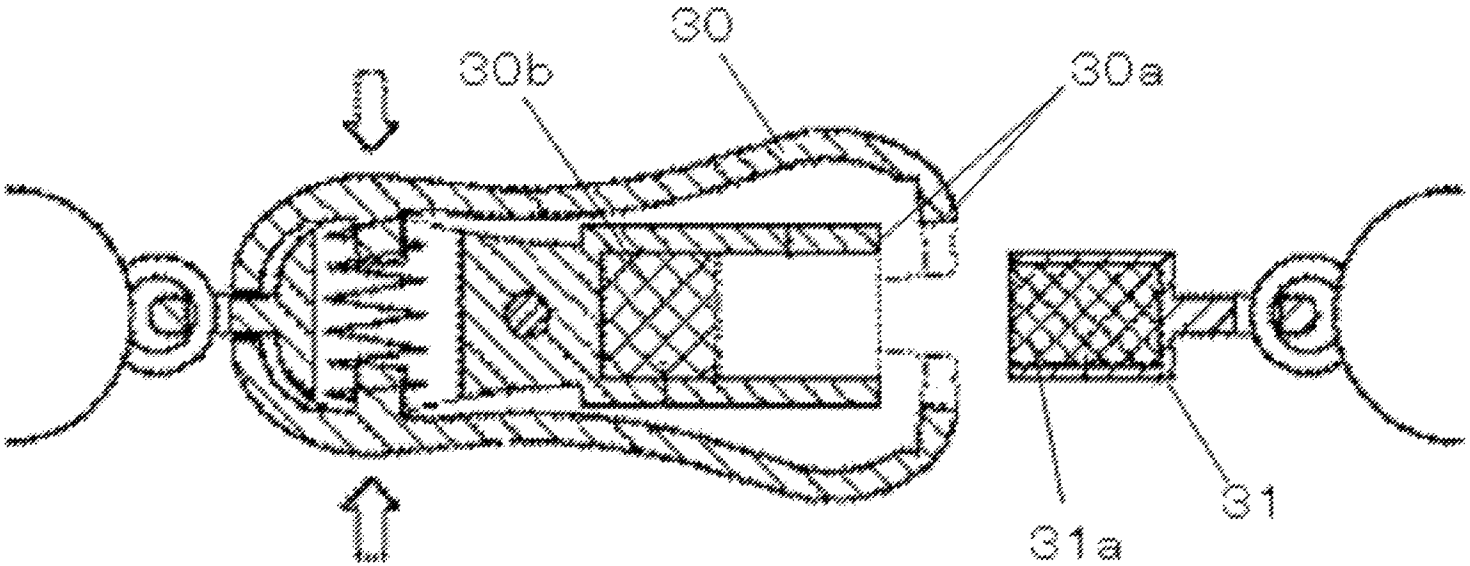
FIG. 7 shows a cross-sectional view of a fastener according to Reference 2.
Figure 8:
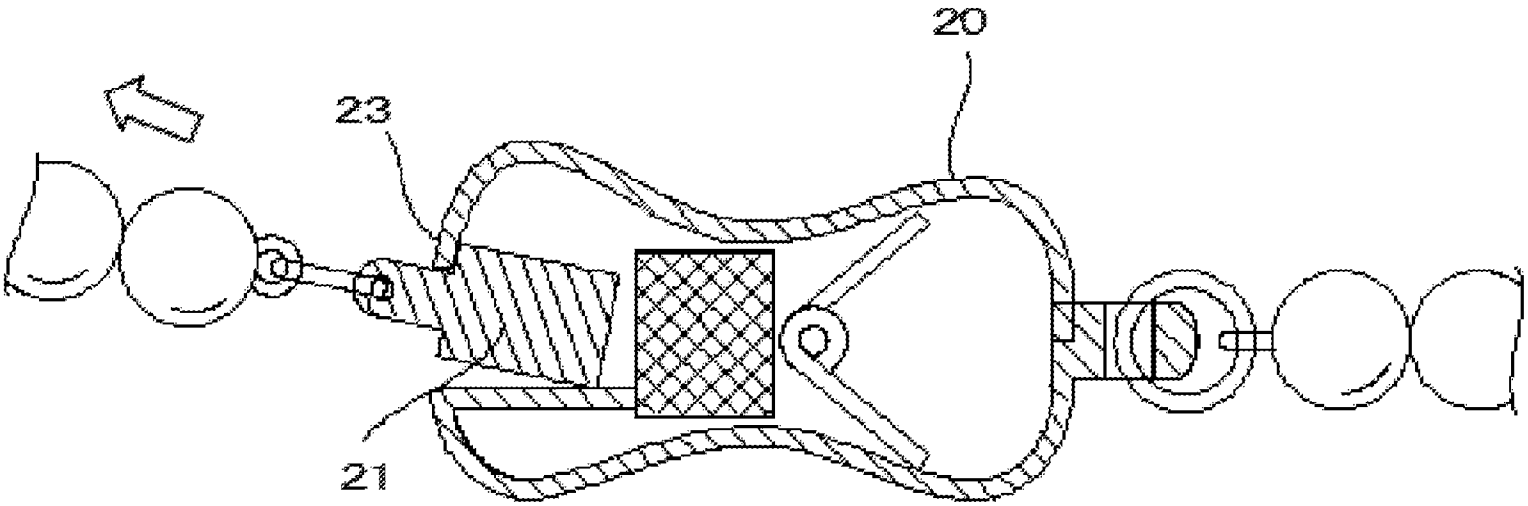
FIG. 8 shows a cross-sectional view of a fastener according to Reference 1.
Figure 9:
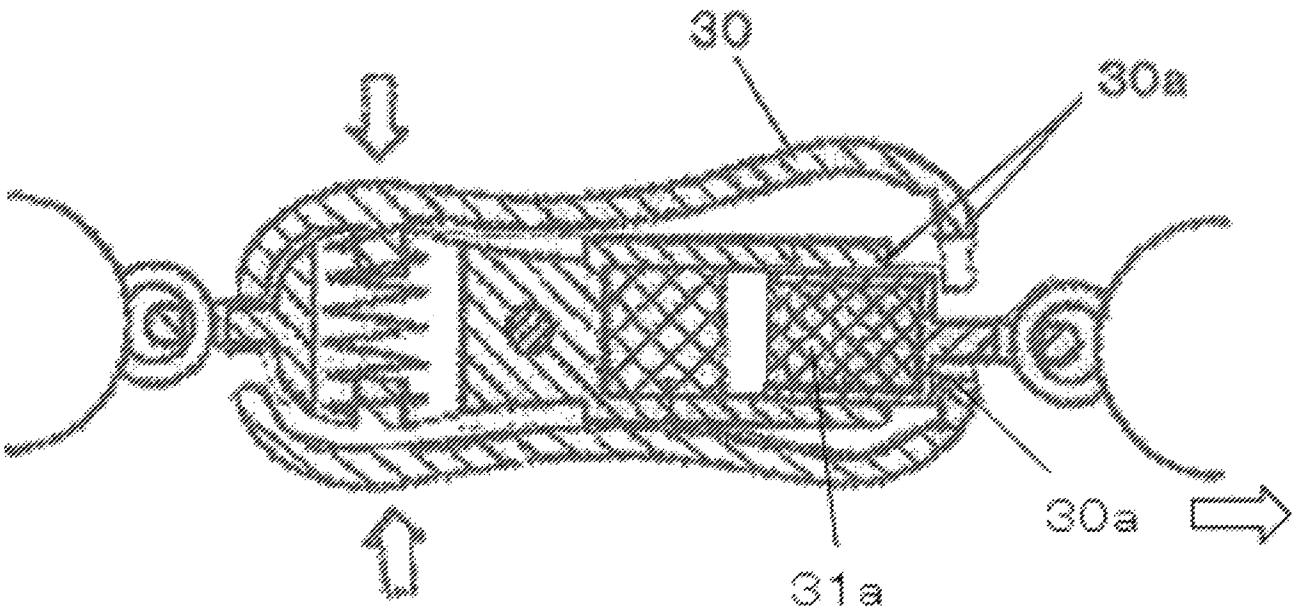
FIG. 9 shows a cross-sectional view of a fastener according to Reference 2.

Herein, the structure of the holder (13) will be explained by referring to FIG. 3 and FIG. 4. The holder (13) is a cylindrical holder (13), into which the cylindrical-locking part (1) can be inserted. As shown in FIG. 3, an opening of the holder (13) is directed towards a lateral direction, provided that an opening (10) of the crocodile clip (5) is directed towards a lateral direction. As shown in the figures, the cylindrical holder (13) has a certain thickness. One opening side of the cylindrical holder (13) touches (or formed together with) the attraction part (14), and the bottom half of the other opening side of the cylindrical holder (13) is interconnected with a semicircular insertion (10), which is formed at the jaw member (7). With this configuration, a guide surface (G) is formed to make the locking part (1) slide horizontally and to guide the locking part (1) into the inner space (16) of the holder (13), wherein the locking part (1) is inserted from outside. Furthermore, the upper half of said other opening of the cylindrical holder (13) engages/disengages the other jaw member (6) of the pair jaw members (6,7), and a stopping part (12) is present at the tip of the jaw member (6).

As shown in FIG. 2 and FIG. 3, the guide surface (G) is a continuous surface comprising an inner surface of the cylindrical holder (13) and a notch surface (7*a*), which is a semicircular insertion and is formed at the jaw member (7) out of the pair of jaw members (6,7). Herein, this continuous surface can be either a connection surface of the inner surface of the cylindrical holder (13) and the notch surface (7*a*) or an integrally formed surface of these. With this configuration, when the crocodile clip (5) opens to the diameter length of the attraction part (2) of the locking part (1), the attraction part (2) can smoothly be inserted into the inner space (16) of the cylindrical holder (13) without being disturbed by any obstacles. As a result of this, the locking part (1) as a male part can be smoothly engaged with the crocodile clip (5) as a female.

Next, the insertion of the fastener for accessories (F) will be explained by referring to FIG. 3. When the male part (1) and the female part (5) are engaged, the rear part of the crocodile clip (5) is pushed to open the opening (10), then the locking part (1) as a male part has to be placed in front of the opening (10) of the crocodile clip (5). Afterwards, the locking part (1) is inserted into the crocodile clip (5) by making use of a magnetic power.

Next, an engagement condition of the fastener for accessories (F) will be explained by referring to FIG. 4. The crocodile clip (5) opens by pushing the rear part of the crocodile clip (5) to the inner direction against the biased spring force when the crocodile clip (5) is in a closed condition. The front of the locking part (1) comprises the attraction part (2). The rear part of the locking part (1) has the neck part (3), which has a thinner diameter than the attraction part (2). As shown in FIG. 4, in a case when the male part (1) and the female part (5) are engaged, the locking part (1) as a male is inserted into the crocodile clip (5) as a female and engaged by the influence of both magnets. After the attraction part (2) of the locking part (1) has been inserted into the inner space (16) of the holder (13), the fingers, which are pressing to the rear part of the crocodile clip (5), will be released so that the stopping part (12) at the tip of the jaw member (6) bites and engages with the neck part (3) of the locking part (1).

Herein, the inner space (16) of the holder (13) is better to be a bit larger than the attraction part (2), and it might be better to have a gap between the holder (13) and the attraction part (2). In addition, the stopping part (12) can be any shape operable to engage the locking part (1). It doesn't matter whether there is a gap between the stopping part (12) and the crocodile clip (5). In the figures, the stopping part (12) is set at one side of jaw member part (6) out of the two jaw members (6,7), and the space between the diameter of the inner space (16) and the attraction part (2) is as less as possible, by having almost the same diameter of the inner space (16) and the attraction part (2). However, it could be possible to have a large space between the diameter of the inner space (16) and the attraction part (2), while making the diameter of the inner space (16) larger than the diameter of the attraction part (2), and while making the stopping parts at both end sides of the jaw member (6) and the jaw member (7).

When engaged, at least one part of the attraction part (2) of the male part (1) is inserted into the inner space (16) of the holder (13). It is better to have a slight gap between the holder (13) and the attraction part (2).

As mentioned above, in this embodiment, a fastener for accessories (F), which engages a female part (5) located at one end of a chain accessory with a male part (1) located at another end side of the chain accessory to lock them: wherein the female part (5) and the male part (1) comprise an attraction part (14) and an attraction part (2) respectively; wherein the attraction part (2) and the attraction part (14) have a part of a pair of magnets respectively or have a magnetic part and a metal part attracted to each other respectively; wherein the attraction part (2) and the attraction part (14) are located in a position to guide the female part (5) and the male part (1) to a correct position; wherein the female part (5) is a crocodile clip (5) comprising a pair of jaw members (6, 7), which are able to open/close by a spring force; wherein the male part (1) is a locking part (1), which is inserted and locked in a space between the pair of jaw members (6,7) when they are in an open state; wherein the attraction part (14) is located in an inner space of the pair of the jaw members (6,7); wherein the crocodile clip (5) comprises the pair of the jaw members (6,7); wherein the attraction part (2) is located at the front part of the locking part (1); wherein the attraction part (14), which is located in the crocodile clip (5), is set to either one of the pair of the jaw members (6,7) (in this Embodiment, the jaw member (7)); and wherein the fastener for accessories (F) comprises a holder (13), into which the attraction part (2) of the locking part (1) is inserted, that is placed in front of the attraction part (14).

With this configuration, in terms of the fastener for accessories (F) according to this Embodiment, the diameter of the holder (13) of the crocodile clip (5) cannot be widen, even when the engaged/disengaged force works from any direction towards the attraction part (2). With this configuration, the engagement between the male part (1) and the female part (5) cannot be released by accident, since this configuration can prevent the attraction part (2) of the male part (1) from widening either one of the stopping part (12) located at the tip of the jaw member (6) of the crocodile clip (5) or the opening (10). In other words, the locking part (1) as a male cannot be disengaged from the crocodile clip (5) as a female part by accident, even if the locking part (1) is pulled to any directions.

Furthermore, the jaw member (7), which is one of the jaw members of the fastener for accessories (F), forms the guide surface (G) that certainly guides the locking part (1) into the inner space (16) of the holder (13). With this configuration, in a case when it is hard to rely on a visual inspection such as at the back of his/her neck, the guide surface (G) can certainly guide the locking part (1) as a male into the inner space (16) of the cylindrical holder (13), which is held in the crocodile clip (5) as a female part, so that very smooth engagement can be achieved. Furthermore, when engaged/disengaged, the same as mentioned above, if the opening (10) opens to the diameter length of the attraction part (2) of the locking part (1), the locking part (1) can be engaged/disengaged smoothly without contacting the stopping part (13), even when the locking part (1) is pulled to any directions.

Furthermore, the crocodile clip (5) comprises the spring (15), which is biased to the opening direction. However, the engagement can be achieved without the strong spring (15). In this case, the opening (10) can be opened by pinching gently the rear part of the crocodile clip (5) to the closing direction. Therefore, the fastener for accessories (F) can be smaller and can be easily engaged/disengaged by pinching the rear parts lightly. In other words, even if the spring force inside the crocodile clip (5) is weak, the locking part (1) as a male part cannot be easily disengaged when the locking part (1) is pulled to any directions. In addition, when the rear part of the crocodile clip (5) is pinched lightly, engagement/disengagement can be easily achieved. Herein, the crocodile clip (5) comprises a pair of the jaw members (6,7) operable to pinch the engagement part of the locking part (1), wherein the jaw members (6,7) are rotatably connected by a spindle. This spindle, which is set between these jaw members (6,7), forces to shift from the opening state to the closing state of the tips of the jaw members (6,7) (which is the engagement part with the locking part (1)).

It is to be noted that the present invention is not limited to the above-described embodiments and modified examples, and various modifications are possible within the spirit and scope of the present invention. For example, the attraction part (2) located at the front of the locking part (1) is not always located at the front. It can be placed near the front part, which is influenced by the magnetic power of the attraction part (14). In other words, the locking part (1) can be the shape operable to be inserted one portion or all portions of the locking part (1) into the inner space (16) of the holder (13). Furthermore, the shape of the holder (13) does not always have a cylindrical shape. It can be a shape operable to hold a part or the whole parts of the locking part (1).

NUMERICAL REFERENCES

1 male part (locking part)
2 magnet (attraction part)
3 neck part
4 end of a chain
5 female part (crocodile clip)
6,7 jaw member
7*a* notch surface
8 connection part connecting a chain
9 spindle
10 insertion (opening)
11 end of a chain
12 stopping part
13 holder (cylindrical holder)
14 attraction part (magnet)
15 spring
16 inner space (space for being inserted a male magnet or an attraction part)
17 a part of a holder or Guide part or base
F fastener for accessories
G guide surface

What is claimed is:

1. A fastener for accessories, which engages a female part located at one end of a chain accessory with a male part located at another end side of the chain accessory to lock them:

wherein the female part and the male part comprise a female attraction part and a male attraction part respectively;

wherein the female attraction part and the male attraction part have a part of a pair of magnets respectively or have a magnetic part and a metal part attracted to each other respectively;

wherein the female attraction part and the male attraction part are located in a position to guide the female part and the male part to a correct position;

wherein the female part is a crocodile clip comprising a pair of jaw members, which are able to open/close by a spring force;

wherein the male part is a locking part, which is inserted and locked in a space between the pair of jaw members when they are in an open state;

wherein the female attraction part is located in an inner space of the pair of the jaw members;

wherein the male attraction part is located at a front part of the locking part;

wherein the female attraction part, which is located in the crocodile clip, is set to either one of the pair of the jaw members;

wherein the fastener for accessories comprises a holder, into which the male attraction part of the locking part is inserted, that is placed in front of the female attraction part;

wherein the holder is located in one jaw member of a pair of the jaw members and an inner surface of the holder forms a guide surface, which is in almost parallel to a jaw member; and wherein the locking part slides along the guide surface of the holder when engaged/disengaged.

2. The fastener for accessories according to claim 1, wherein an opening of the holder is directed towards a lateral direction, provided that an opening of the crocodile clip is directed towards a lateral direction; and wherein the inner surface guides a horizontal slide of the locking part in an inner space of the holder.

3. The fastener for accessories according to claim 2, wherein the holder is a cylindrical holder, into which the cylindrical-locking part can be inserted.

4. The fastener for accessories according to claim 3, wherein the guide surface is a continuous surface comprising an inner surface of the cylindrical holder and a notch surface, which is a semicircular insertion and is formed at the jaw member out of the pair of jaw members); and wherein the inner surface of the cylindrical holder is on a same surface of the semicircular insertion.

5. The fastener for accessories according to claim 3, wherein a bottom half of the opening side of the cylindrical holder is interconnected with the semicircular insertion, which is formed at the jaw member out of the pair of the jaw members;

wherein a top half of the opening side of the cylindrical holder is engaged/disengaged with the jaw member out of the pair of the jaw members; and wherein a stopping part is placed at a tip of the said jaw member.

* * * * *